US005690566A

United States Patent [19]

Bracho

[11] Patent Number: 5,690,566

[45] Date of Patent: Nov. 25, 1997

[54] END CAP FOR RACKET HANDLE

[76] Inventor: Juan Bracho, 5327 Patrick Henry, Bellaire, Tex. 77401

[21] Appl. No.: 736,198

[22] Filed: Mar. 15, 1996

Related U.S. Application Data

[63] Continuation of Ser. No. 439,453, May 11, 1995, abandoned, which is a continuation of Ser. No. 294,776, Aug. 23, 1994, abandoned, which is a continuation of Ser. No. 121,842, Sep. 15, 1993, abandoned, which is a continuation of Ser. No. 37,509, Mar. 24, 1993, Pat. No. 5,295,684, which is a continuation of Ser. No. 835,613, Feb. 13, 1992, abandoned.

[51] Int. Cl.[6] ..... A63B 49/08

[52] U.S. Cl. ..... 473/549; 473/300

[58] Field of Search ..... 473/549, 551, 473/300, 301, 302

[56] References Cited

U.S. PATENT DOCUMENTS

| | | | |
|---|---|---|---|
| 1,026,990 | 5/1912 | Matson | 273/73 J |
| 4,828,261 | 5/1989 | Kleylein | 273/73 J X |
| 5,058,902 | 10/1991 | McCutchen | 273/73 J |

FOREIGN PATENT DOCUMENTS

| | | | |
|---|---|---|---|
| 17636 | 1/1929 | Australia | 273/73 J |
| 1473295 | 2/1967 | France | 273/73 J |
| 2254275 | 11/1973 | Germany | 273/73 J |
| 3934209 | 4/1991 | Germany | 273/73 J |
| 12930 | of 1889 | United Kingdom | 273/73 J |
| 20452 | 9/1902 | United Kingdom | 273/73 J |
| 1144628 | 3/1969 | United Kingdom | 273/73 J |

*Primary Examiner*—William E. Stoll
*Attorney, Agent, or Firm*—Caesar, Rivise, Bernstein, Cohen & Pokotilow, Ltd.

[57] ABSTRACT

An end cap for use on various types of handles is disclosed. The end cap can be used in conjunction with racquet handles such as for tennis, racquetball, squash and badminton. The end cap can also be used with handles such as for golf clubs, construction hammers, polo sticks. The end cap comprises a wrap located at the first end portion of the handle and extends toward the second end portion of the handle. The wrap has a first thickness at the first end portion of the handle, a second thickness spaced from the first thickness, and a third thickness spaced from the first thickness along the longitudinal portion. The second thickness is greater in thickness than the first thickness. The third thickness is less in thickness than the first thickness and the second thickness is located between the first and third thicknesses. The end cap also has a bridge section that extends in a non-linear manner between the second and third thicknesses. Three embodiments of the end cap are disclosed. In the first embodiment, the end cap comprises a thickened shock absorbent wrap. In the second embodiment, the end cap comprises a blanket member and an overwrap member. In the third embodiment, the end cap comprises a butt cap member and an overwrap member.

2 Claims, 4 Drawing Sheets

FIG. 9
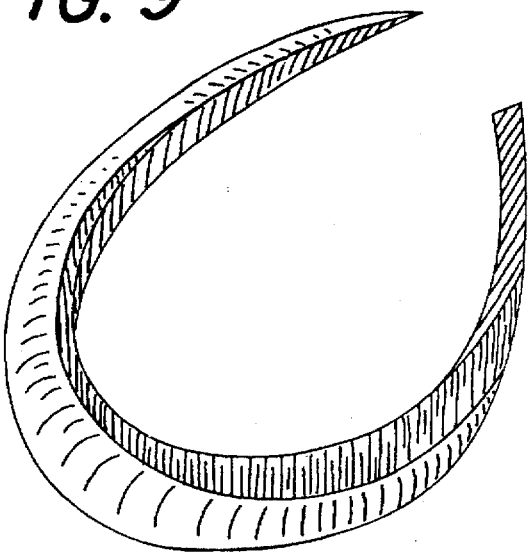
FIG. 10
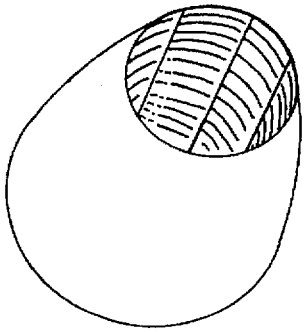
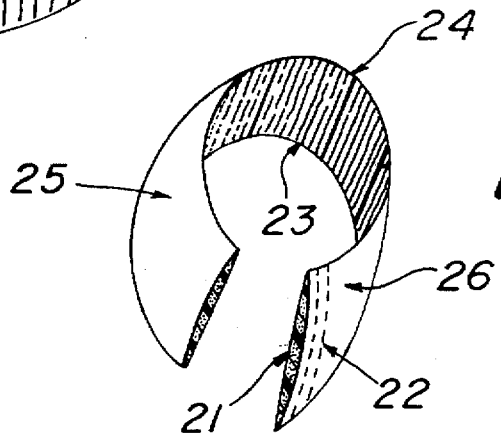
FIG. 11
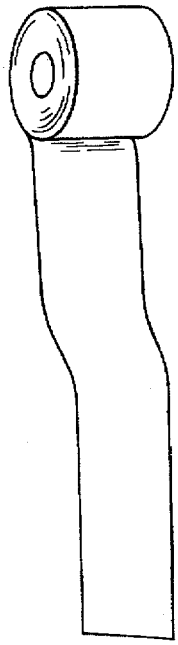
FIG. 12
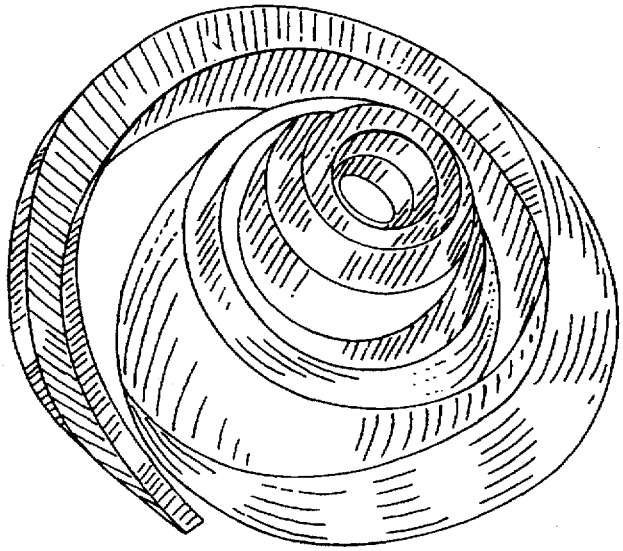
FIG. 13

END CAP FOR RACKET HANDLE

This is a file wrapper continuation of application Ser. No. 08/439,453, now abandoned filed May 11, 1995, which is a continuation of application Ser. No. 08/294,776, now abandoned filed Aug. 23, 1994, which is a continuation of Application Ser. No. 08/121,842, filed Sep. 15, 1993, now abandoned, which is a continuation of application Ser. No. 08/037,509, filed Mar. 24, 1993 and issued Mar. 22, 1994 (U.S. Pat. No. 5,295,684), which is a continuation of Application Ser. No. 07/835,613, filed Feb. 13, 1992, now abandoned.

BACKGROUND OF THE INVENTION

The background of the invention will be set forth in three parts.

1. Field of the Invention

The present invention relates to a revolutionary shape of a sport racquet or hammer handle that improves control of the movement of such racquet or hammer head. More particularly, the present invention relates to an accessory that can be used in all the competitive racquet sports such as tennis, racquetball, squash, and badminton. This accessory also has other non-racquet handle applications, such as with a golf club handle, polo stick, and even an ordinary construction hammer.

2. Technological Facts about Tennis

As the competition in racquet sports increases, new racquet designs have been developed to increase the power, control, and maneuverability of such racquets.

In theory, the goal of racquet design is to increase the power imparted to the ball as well as to increase a player's control over the ball as it contacts the racquet head.

Power in tennis is a function of the force transferred from a player's body to the ball with the use of the tennis racquet. Therefore, a powerful racquet permits players of lesser strength to hit comparable shots.

Power without control is known to give players no extra benefit in the competitive arena. However, control over a shot depends on the spin imparted to the ball at the point when power is applied. For this reason, new technology has always improved the power of such racquet frames first and then improved the control of such new power. This game has been a race between the technology of power against the technology of control.

The ability to impart control (spin) to the ball depends also on different physical characteristics of the racquet such as: string thickness, string tension, balance of the racquet weight, flexibility of the frame, amount of frame vibration and grip quality.

It is known that all these physical characteristics of the racquet affect the player's ability to impart a rotational torque (spin) on the ball. The other obvious factor which is essential to a player's control is his body movement technique. These body movements include footwork, body position and shoulder, elbow, hand, and wrist movements.

Therefore, since the entire body movement technique is for the sole purpose of controlling the racquet head, and the physical characteristics of the racquet are so important, we can say that the link between the racquet and the hand of the player, i.e., the grip, is perhaps the most essential factor in the manipulation of the racquet head. The invention of the present application relates to an end cap for use on a racquet handle. This end cap will benefit millions of players of all ages and levels.

3. Description of the Prior Art

U.S. Pat. Nos. 4,213,609 (Swanson), 3,905,598 (Ballog), and 3,817,521 (Wright) add a structure above the hand on the racquet shaft. These patents do not allow the player to lock his hand to the shaft. We know that as a racquet is swung in an arc, the centrifugal force acting on the racquet urges the racquet away from the player and the player's grasp. We also know that perspiration on the grip reduces the coefficient of friction between the racquet grip and the player's hand. In fact, the player must grip the racquet shaft even more tightly to prevent the racquet from flying out of his hand. We conclude from our experiments that the problem of slippage was not solved by the above patents.

Some new developments have focused on the racquet handle as the link between the racquet head and the muscle and sinew of a player's arm and hand. However, only the so called "hightech" synthetic grips and "overwraps" have improved the racquet handles of today's new high tech racquets. "Overwraps" seek to overcome problems caused by perspiration of the player's hand. "Hightech" synthetic grips overcome three problems; the uncomfortable sensation of a wet grip due to perspiration, substantial friction reduction and some shock absorption.

The problem of perspiration has been addressed and successful developments attained in the construction of new grip materials which replace the customary leather grips. These synthetic grip materials do not absorb moisture and do not become as slick as traditional leather grips. In addition, slightly flared racquet end caps or butt caps have been utilized for many years to close the end of the racquet handle and to reduce the possibility that the racquet might slip from the player's grasp.

Other attempts of improving the racquet handle such as in U.S. Pat. Nos. 3,817,521 (Wright); 3,905,598 (Ballog); 4,033,583 (Ehrhart); 4,213,609 (Swanson); 4,226,418 (Balfour), and Des. 289,671 (Abel) for example have not been proven successful in overcoming the problems mentioned above.

Other patents that have shown development of the conventional handle are: 4,072,312 (Kahn), and 3,501,148 (Cheris, Bigos, and Mox) which emphasize the importance of the octagonally-shaped shaft.

The octagonally-shaped shaft and butt cap have been used for many years. The basic reasoning behind the importance of the octagonal shape is the following: since the baseline to baseline length of a tennis court is 78 feet, the angle that the ball is initially projected is critical to the path of the ball over the length of a tennis court. For example, a one degree change in the angle of force will result in a one and one-half foot elevation change in the flight of the ball over the length of a tennis court. A slight variation in the angle of the racquet head will determine whether the ball lands within the boundaries of the court or if the ball lands out of play. The only way a player can feel the position of the head of the racquet, without looking at it, is by feeling the bevels of the octagonally-shaped shaft. Since the octagonally-shaped shaft has a side parallel to the face of the racquet, the player can determine the position of such face by feel rather than sight.

The octagonally-shaped shaft is therefore useful. However, the sides of such a polygonal shaft and butt cap continue to cause friction to the hands of the players.

The optimal grip would enable a player to determine orientation of the head, provide shock absorption, minimal friction, and repel perspiration without causing perspiration.

Recent developments in racquet handles are described on pages 146 and 147 of the September, 1989 issue of *Tennis*

*Magazine.* The role of the racquet grip as a means for controlling the racquet head is described in an article entitled "Handle Systems, Get a Grip!" In an illustration entitled "Shapes of the Future" on page 147, the hourglass and ribbed overwrap concepts are described. In the hourglass concept, the player grips the most narrow, tapered portion of a racquet handle. In the ribbed overwrap concept, the traditionally shaped rib reduces slippage of the hand relative to the racquet handle. Neither of these concepts have become widely accepted since the hourglass grip cannot be used by players who grip the racquet handle with both hands and because the hourglass slope does not fit the natural contour of a player's hand.

Although the ribbed overwrap concept is likely to reduce slippage of the player's hand on the racquet handle, the ribbed overwrap concept does not permit fine finger control over the racquet by players who adjust their hand and finger position during racquet use.

It is apparent that all known racquet handles do not overcome all the problems set forth above. Accordingly, a need exists for a racquet handle which permits a person to control racquet head movement without slippage of the handle, a handle that absorbs shock and reduces friction without the player's losing sensory perception of the position of the head of the racquet.

SUMMARY OF THE INVENTION

The present invention overcomes the disadvantages of the prior art by disclosing an end cap for use on a racquet handle. This end cap is known as the Racquet Joint Cap (R.J.C.). The end cap of the present invention gives the player more maneuverability because of its increased circumference, i.e., between 5½ and 6¾ inches. The end cap of the present invention reduces the possibility of undesirable slippage due to its "S" shape bridge section. The end cap of the present invention does not inhibit a player's ability for determining the orientation of the head of the racquet because it does not interfere with the player's ability to feel the octagonal shape of the shaft. The end cap of the present invention reduces the possibility of injuries to the player due to friction because of its rounded shape. Most importantly, the end cap of the present invention gives the player more power because it allows him to lock his hand with the handle with a relaxed grip, giving him the ability to whip the ball. The end cap of the present invention adds control because it allows the player to strike the ball in a fashion which causes the ball to rotate about its center with much more ease than is available with the conventional racquets.

BRIEF DESCRIPTION OF THE DRAWINGS

FIG. 9 shows a wrap made of a spongy material. The wrap comprises a first embodiment of the end cap of the present invention.

FIG. 10 shows a butt cap member made of a shock absorbent material. The butt cap member utilized in conjunction with an overwrap member is a second embodiment of the end cap of the present invention.

FIG. 11 shows a blanket member, which is made out of a spongy material. The blanket member utilized in conjunction with an overwrap member comprises a third embodiment of the end cap of the present invention.

FIG. 12 shows the overwrap member of the present invention. The overwrap member is utilized in conjunction with the butt cap member under the second embodiment of the present invention mentioned previously. The overwrap member is utilized in conjunction with the blanket member under the third embodiment of the present invention described above.

FIG. 13 shows one layer of conventional "Hightech" grip with the R.J.C. wrap attached to it.

DESCRIPTION OF THE PREFERRED EMBODIMENTS

Figure 1:
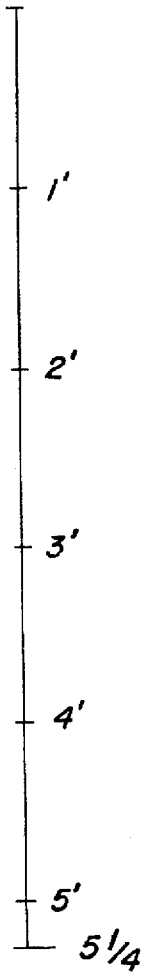
FIG. 1 shows the maximum outer diameter of a conventional butt cap. This distance is 5¼ inches.

Referring to FIG. 1, the distance of the maximum outer circumference of the conventional butt cap is illustrated. We researched conventional butt caps from different manufacturing companies and found that not one conventional butt cap had a maximum outer circumference larger than 5¼ inches. (FIGS. 1 and 3).

Figure 2:
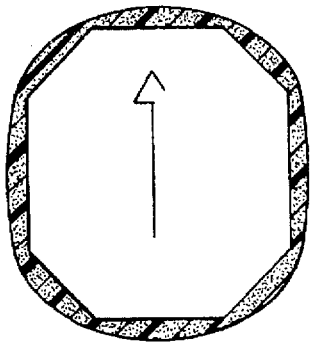
FIG. 2 is an end sectional view of the racquet handle with the end cap of the present invention attached.
Figure 3:
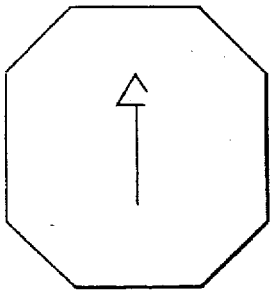
FIG. 3 is an end sectional view of the racquet handle without the end cap of the present invention attached.
Figure 4:
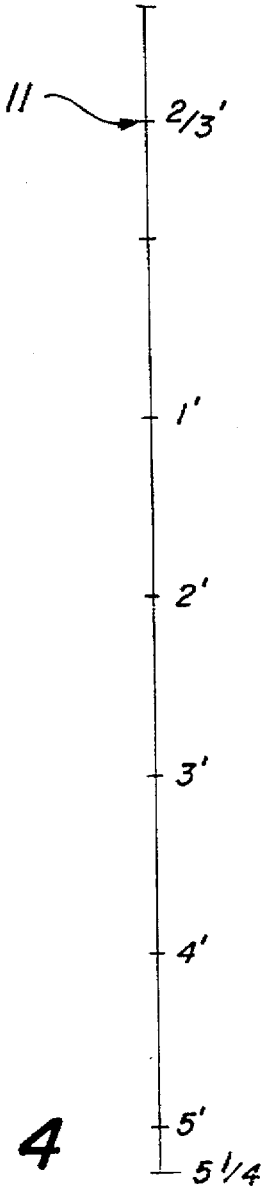
FIG. 4 shows the maximum outer circumference of the end cap of the present invention which is ⅔ of an inch greater than 5¼ inches which is the maximum outer circumference of conventional butt caps.
Figure 5:
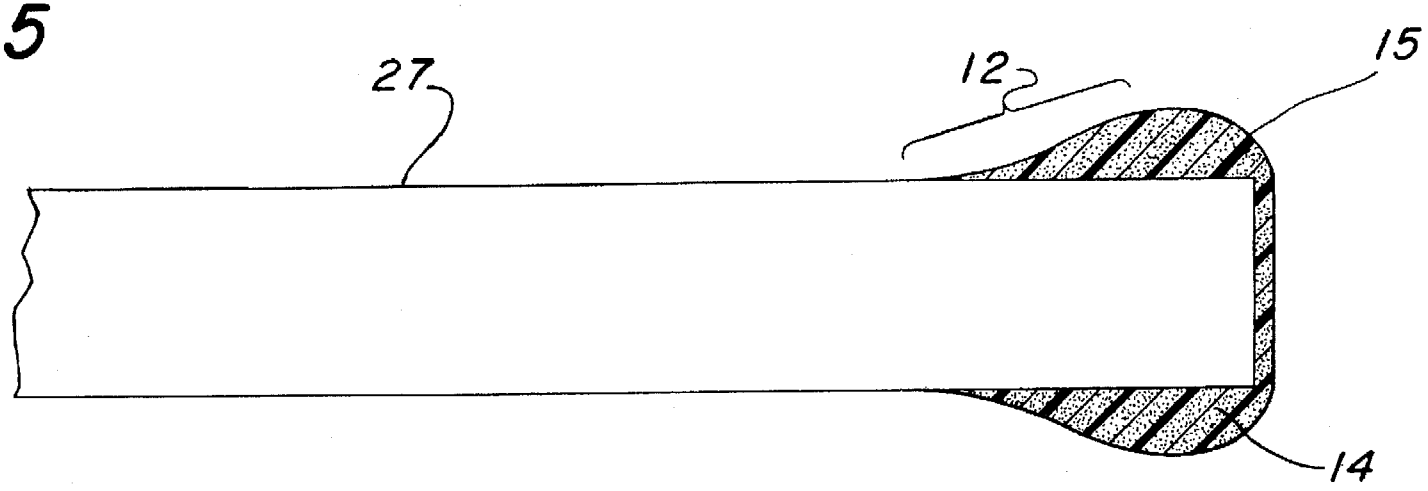
FIG. 5 is a side sectional view of the shaft of the racquet with the end cap of the present invention attached.

We found that the optimal maximum outer circumference of the end cap of the present invention is ⅔ of an inch greater (FIGS. 2 and 4) than the 5¼ inches in maximum outer circumference of the conventional butt caps (FIG. 3). The ⅔ of an inch increased maximum outer circumference allows the end cap of the present invention to have a bridge section 12 (FIG. 5).

The bridge section 12 (FIG. 5) is the feature of the end cap of the present invention that helps the player to lock his hand when he strikes the ball with the racquet (not pictured). As shown in (FIG. 6), the conventional butt cap does not have a gradual nonlinear bridge section. Rather, the conventional butt cap has a linear ramp 13. This conventional butt cap does not lock the hand with the racquet.

As shown in (FIG. 5), the end cap of the present invention is manufactured out of a spongy, shock absorbent material 14. This thickness gives the player extra cushioning and feel for the grip. The thickness traps the vibrations that are so common now with stiffer frames.

Figure 6:
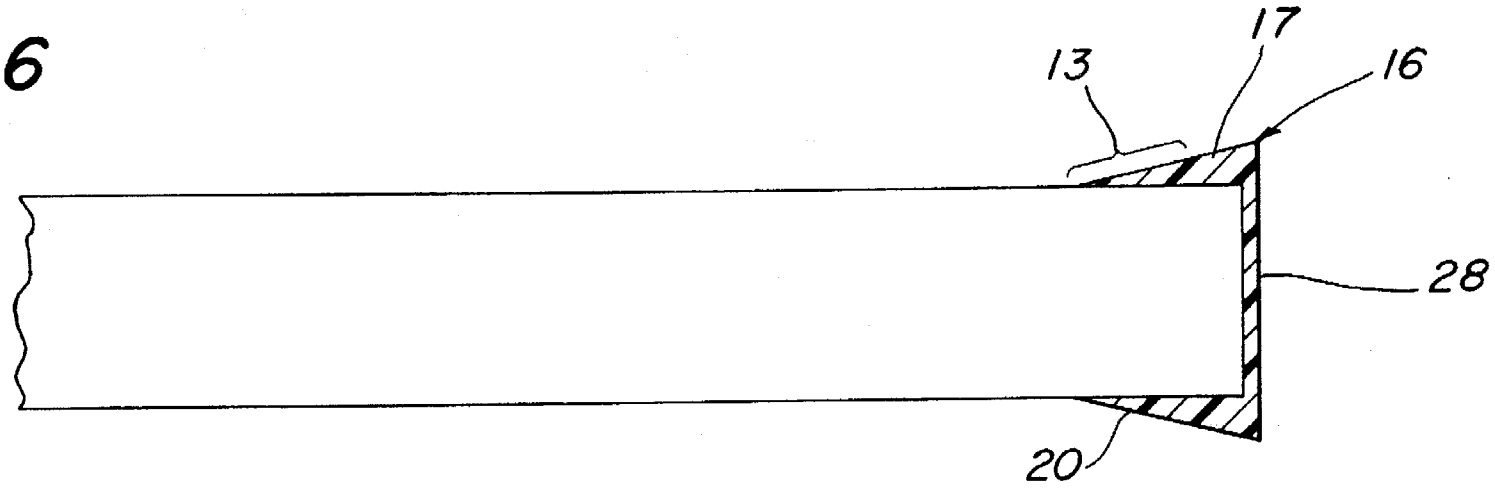
FIG. 6 is a side sectional view of the shaft of the racquet with the conventional butt cap attached.
Figure 7:
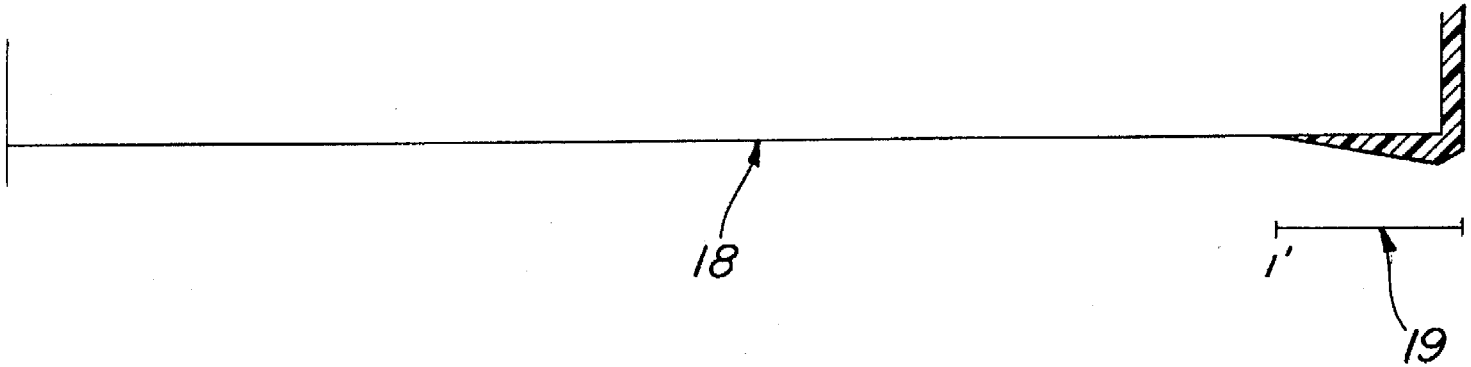
FIG. 7 is a side sectional view of the length of the conventional butt cap.
Figure 8:
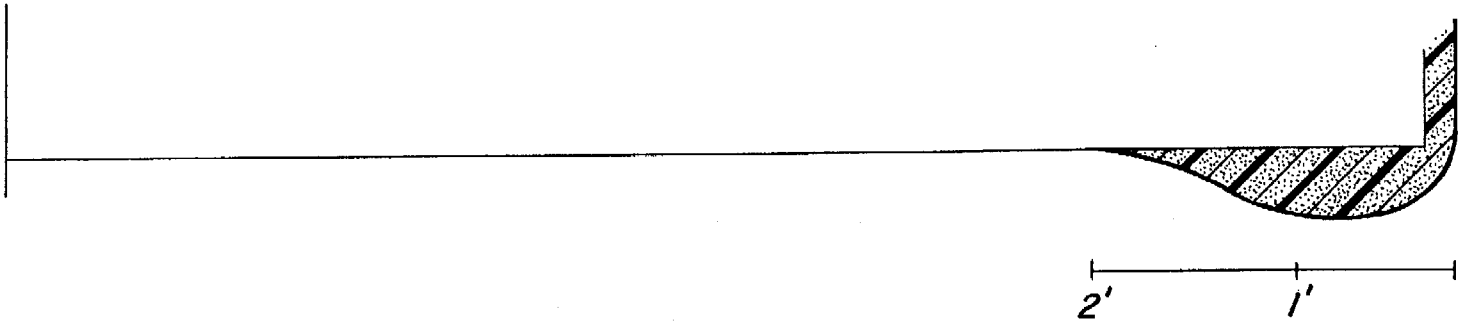
FIG. 8 is a side sectional view of the length of the end cap of the present invention.

As shown in FIG. 7, a conventional butt cap 19 measures one inch in length. It is well known by competitive tennis players that conventional butt caps have the tendency to break from the handle. Most of these conventional butt caps have to be nailed to the shaft which damages the shaft of the racquet. Since the conventional butt cap (FIG. 6) is made out of plastic, the butt cap 20 bends easily and is not as stable as the end cap of the present invention (FIG. 8).

As stated previously, the wrap (FIG. 9), butt cap member (FIG. 10) utilized in conjunction with an overwrap member, and blanket member (FIG. 11) utilized in conjunction with the overwrap member are three embodiments of the end cap of the present invention. The butt cap member, wrap, and blanket member each have a rounded edge 15 (FIG. 5) that does not puncture the hand of the player. Sharp angles found on conventional butt caps 16 made of plastic material 17 not only cause blisters to the hand but also do not stop any racquet vibration.

The end cap of the present invention (FIG. 8) measures two inches in length and its length by itself makes the end cap very stable. The embodiment of the present invention comprising a blanket member and an overwrap member (FIG. 11) does not need to be nailed, glued, or stapled to the shaft. The blanket member is positioned on top of the conventional butt cap. After the blanket member is positioned and cut to fit over the maximum outer circumference of the conventional butt cap, it only needs one layer of overwrap member (FIG. 12) on top of it.

The embodiment of the end cap of the present invention comprising a blanket member and an overwrap member (FIG. 11) is perhaps the most desirable embodiment for several reasons. The spongy material 21 reduces shock. The size of the blanket member is adjustable by means of cutting lines 22 which enable the blanket member to fit the different circumferences of the handles. The blanket member has an inner circumference 23 of at least 5¼ inches and an outer circumference 24 of at least 4¼ inches. The top part of the blanket member 25 forms the bridge section and the middle thick part of the blanket member 26 forms a maximum outer circumference of ⅔ of an inch greater (FIG. 2) than the circumference of the conventional butt cap (FIG. 3).

The blanket/overwrap (FIG. 11) and the wrap embodiments (FIG. 13) are the two embodiments of the end cap of the present invention that may be implemented without having to take away anything from the prior art, i.e., the existing conventional end cap does not need to be removed to implement these embodiments. These two embodiments will allow manufacturing companies to test the market of the end cap of the present invention without abandoning the conventional methods used today.

The butt cap member (FIG. 10) is installed in the shaft 27 (FIG. 5) after removing the old conventional butt cap 28 (FIG. 6). This embodiment of the end cap of the present invention is beneficial to those players who know the [R.J.C.] benefits of this invention and want a long lasting secure butt cap.

From the foregoing, it should be evident that a very advantageous and novel improvement in tennis racquet accessories has been described which significantly advances the art.

Although only a limited number of embodiments of the invention have been described in detail, it should be understood that other embodiments and modifications of the invention may be constructed in accordance with the teachings of this invention. Accordingly, it should be understood that the foregoing disclosure and drawings are to be considered only as illustrations of the principles of this invention.

I claim:

1. An end cap in combination with a racket handle, said racket handle having a first end portion, a second end portion, and a length extending therebetween, the first end portion of said racket handle having a racket head secured thereto, the second end portion of said racket handle being free, said end cap being disposed at the second end portion of the racket handle, said end cap comprising:

a. a cushioned butt cap member formed of a spongy, shock absorbent material and being positionable over the second end portion of said racket handle;

b. an overwrap member formed of an elongated strip of thin material, said overwrap member being wrapped over said butt cap member and wrapped over a portion of said length of said racket handle;

c. said end cap further having a first thickness located at said second end portion of said racket handle, a second thickness spaced from said first thickness along said length of said racket handle, said second thickness being greater in thickness than said first thickness;

d. a bridge section extending from said second thickness towards said racket head, said bridge section tapering gradually and nonlinearly along said length of said racket handle as said bridge section extends from said second thickness towards said racket head; and, e. the length of said end cap, measured from said first thickness to the end of said bridge section closest to said racket head, being greater in length than said second thickness.

2. A cushioned butt cap member in combination with a racket handle, said racket handle having a first end portion, a second end portion, and a length extending therebetween, the first end portion of said racket handle having a racket head secured thereto, the second end portion of said racket handle being free, said butt cap member being positionable over the second end portion of said racket handle and comprising:

a. a first thickness located at said second end portion, a second thickness spaced from said first thickness along said length of said racket handle, said second thickness being greater in thickness than said first thickness;

b. a bridge section extending from said second thickness towards said racket head, said bridge section tapering gradually and nonlinearly along said length of said racket handle as said bridge section extends from said second thickness towards said racket head, said butt cap being greater in length than said second thickness; and c. said butt cap member being formed of a spongy, shock absorbent material.

* * * * *